US011133172B2

(12) United States Patent
Kihara et al.

(10) Patent No.: US 11,133,172 B2
(45) Date of Patent: Sep. 28, 2021

(54) FLASH DISCHARGE TUBE AND FLASH DEVICE

(71) Applicant: Panasonic Intellectual Property Management Co., Ltd., Osaka (JP)

(72) Inventors: Shinji Kihara, Kyoto (JP); Kazuhiro Daijo, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/251,949

(22) PCT Filed: Jun. 21, 2019

(86) PCT No.: PCT/JP2019/024668
§ 371 (c)(1),
(2) Date: Dec. 14, 2020

(87) PCT Pub. No.: WO2020/004251
PCT Pub. Date: Jan. 2, 2020

(65) Prior Publication Data

US 2021/0265156 A1 Aug. 26, 2021

(30) Foreign Application Priority Data

Jun. 27, 2018 (JP) ..... JP2018-121420
Apr. 10, 2019 (JP) ..... JP2019-074606

(51) Int. Cl.
*H01J 61/54* (2006.01)
*H01J 61/80* (2006.01)
*H01J 61/06* (2006.01)

(52) U.S. Cl.
CPC ..... *H01J 61/54* (2013.01); *H01J 61/06* (2013.01); *H01J 61/547* (2013.01); *H01J 61/80* (2013.01)

(58) Field of Classification Search
CPC ..... H01J 61/54; H01J 61/547; H01J 61/80
(Continued)

(56) References Cited

U.S. PATENT DOCUMENTS 4,887,002 A * 12/1989 Dobashi ..... H01J 61/35 313/607
2012/0176059 A1* 7/2012 Ogino ..... H01J 61/547 315/224

FOREIGN PATENT DOCUMENTS

JP 4-054141 U 5/1992
JP 2003-288861 10/2003

OTHER PUBLICATIONS

International Search Report of PCT application No. PCT/JP2019/024668 dated Sep. 10, 2019.

* cited by examiner

*Primary Examiner* — Christopher M Raabe
(74) *Attorney, Agent, or Firm* — McDermott Will and Emery LLP

(57) ABSTRACT

There are provided a glass tube in which a rare gas under predetermined pressure is sealed, a cathode electrode and an anode electrode disposed in a first end portion and a second end portion of the glass tube, respectively, facing each other, and a trigger electrode including a transparent conductive film formed on an outer peripheral surface of the glass tube. The trigger electrode includes an electrode body disposed on the outer peripheral surface of the glass tube, along a tube axis direction of the glass tube, and an enlarged portion that covers at least any one of the cathode electrode and the anode electrode, and that has a circumferential width wider than a circumferential width of the electrode body. This provides a flash discharge tube capable of reducing variations in optical distribution characteristics during light emission with a small amount of light, and improving life
(Continued)

durability during continuous emission of a large amount of light and at short intervals.

7 Claims, 12 Drawing Sheets

(58) Field of Classification Search
USPC ..... 313/607
See application file for complete search history.

FLASH DISCHARGE TUBE AND FLASH DEVICE

CROSS-REFERENCE TO RELATED APPLICATIONS

This application is a U.S. national stage application of the PCT International Application No. PCT/JP2019/024668 filed on Jun. 21, 2019, which claims the benefit of foreign priority of Japanese patent application No. 2018-121420 filed on Jun. 27, 2018 and Japanese patent application No. 2019-074606 filed on Apr. 10, 2019, the contents all of which are incorporated herein by reference.

TECHNICAL FIELD

The present invention relates to a flash discharge tube and a flash device using the same.

BACKGROUND ART

Generally, a flash discharge tube includes a glass tube, a trigger electrode, a cathode electrode, and an anode electrode. Xenon gas under predetermined pressure is sealed inside the glass tube. The trigger electrode is composed of a transparent conductive film and is formed on an outer peripheral surface of the glass tube. The cathode electrode and the anode electrode are disposed in a first end portion and a second end portion of the glass tube, respectively, facing each other.

The flash discharge tube is provided in various forms depending on application (e.g., refer to PTLs 1 and 2).

PTL 1 describes flash discharge tube 3 that is used as an artificial light source for photography, for example, as illustrated in FIG. 10. Specifically, flash discharge tube 3 includes a plurality of trigger electrodes 31 that is formed on an outer peripheral surface of glass tube 30 in a circumferential direction and that is each formed linearly in an axial direction having a different width. This provides flash discharge tube 3 capable of emitting a flash of light in the circumferential direction of glass tube 30.

FIG. 11 also illustrates a form of flash discharge tube 4. Flash discharge tube 4 includes trigger electrode 41 that has a width corresponding to 180° or 150° in a circumferential direction of an outer peripheral surface of glass tube 40, and that is linear in an axial direction. This provides flash discharge tube 4 capable of reducing variations in optical distribution characteristics by stabilizing a discharge optical path during light emission with a small amount of light.

PTL 2 describes flash discharge tube 5 that is used, for example, as a fixing light source of a high-speed printer, as illustrated in FIG. 12. Specifically, flash discharge tube 5 includes trigger electrode assembly 51 that is disposed on an outer peripheral surface of arc tube 50 (corresponding to the glass tube) and that improves startability. Trigger electrode assembly 51 is composed of trigger line 510, metal wire Y, and the like. Trigger line 510 is disposed on an outer peripheral surface of arc tube 50 along an axial direction from near first electrode 500 to near second electrode 501. Metal wire Y is spirally wound around the outer peripheral surface of arc tube 50 to prevent trigger line 510 from being released at a central portion of arc tube 50.

FIG. 13 illustrates a form of flash discharge tube 6. Flash discharge tube 6 includes conductive silver paint P that is linearly formed on an outer peripheral surface of glass tube 60 by baking along the axial direction. This provides flash discharge tube 6 capable of stabilizing the discharge optical path.

Generally known flash discharge tubes are each capable of stabilizing a discharge optical path by narrowing a width of a trigger electrode.

However, when flash discharge tube 3 described in PTL 1 includes trigger electrode 31 having a narrow width and performs continuous light emission with a large amount of light and at short intervals, glass tube 30 has a surface at high temperature. This causes glass tube 30 to expand and contract. As a result, trigger electrode 31 may be locally burned out to cause crack A in trigger electrode 31, as illustrated in FIG. 14. That is, crack A causes a potential difference between opposing end portions B, B of trigger electrode 31 (between adjacent conductors). The potential difference between opposing end portions B, B causes a spark due to atmospheric discharge on the outer peripheral surface of glass tube 30. Then, the cracked portion serves as an insulator, and the crack develops with increase in range of the cracked portion as frequency of light emission increases. This causes trigger electrode 31 not to work, so that flash discharge tube 3 cannot emit light. As a result, life of flash discharge tube 3 is shortened.

When flash discharge tube 4 illustrated in FIG. 11 performs continuous light emission with a large amount of light and at short intervals for trigger electrode 41 having a width corresponding to 180°, for example, trigger electrode 41 partly has worm-eaten cracks. However, conductivity of an outer surface between internal electrodes is ensured. In contrast, when the above light emission is performed by narrowing a width of trigger electrode 41 to less than that corresponding to 180° or 150° to stabilize the discharge optical path, trigger electrode 41 may be burned out due to heat generation and heat accumulation caused by the light emission, as in flash discharge tube 3 described above. As a result, life of flash discharge tube 4 is shortened.

Flash discharge tube 5 described in PTL 2 requires time to position metal wire Y in a winding process of winding metal wire Y around arc tube 50. Metal wire Y wound causes arc tube 50 to be partly shielded from light. Thus, when metal wire Y varies in winding position or the like, optical distribution characteristics of flash discharge tube 5 deteriorate. Additionally, arc tube 50 expands and contracts in the axial direction, so that metal wire Y is likely to be separated from arc tube 50.

Flash discharge tube 6 illustrated in FIG. 13 is shielded from light by silver paint P. When continuous light emission is performed with a large amount of light and at short intervals, silver paint P may be scorched due to heat generation and heat accumulation caused by the light emission.

CITATION LIST

Patent Literature

PTL 1: Unexamined Japanese Patent Publication No. 2003-288861

PTL 2: Unexamined Japanese Utility Model Publication No. 04-54141

SUMMARY OF THE INVENTION

The present invention provides a flash discharge tube capable of improving durability of a trigger electrode during continuous light emission with a large amount of light and at a short interval to extend life, and a flash device using the same.

The flash discharge tube of the present invention includes a glass tube in which a rare gas under predetermined pressure is sealed, a cathode electrode and an anode electrode disposed in a first end portion and a second end portion of the glass tube, respectively, facing each other, and a trigger electrode including a transparent conductive film formed on an outer peripheral surface of the glass tube. The trigger electrode includes an electrode body disposed on the outer peripheral surface of the glass tube, along a tube axis direction, and an enlarged portion that covers at least any one of the cathode electrode and the anode electrode and that has a circumferential width wider than a circumferential width of the electrode body.

This structure allows the conductive film constituting the trigger electrode on the outer peripheral surface of the glass tube to include the enlarged portion. Thus, the trigger electrode formed on the glass tube is less likely to crack. This enables extending the life of the flash discharge tube.

A flash device of the present invention includes the above flash discharge tube and a trigger circuit for applying a trigger voltage to the trigger electrode of the flash discharge tube.

Even when continuous emission of a large amount of light at short intervals causes the trigger electrode to crack due to expansion and contraction in the tube axis direction of the glass tube, this configuration enables preventing a spark to be generated between opposing end portions across the crack, due to application of the trigger voltage. This enables extending life of the flash device.

DESCRIPTION OF EMBODIMENT

Hereinafter, an exemplary embodiment of the present invention will be described with reference to the drawings. The following exemplary embodiment does not limit the scope of the present invention.

Exemplary Embodiment

A flash discharge tube according to the exemplary embodiment of the present invention and a flash device using the same will be described with reference to the drawings.

First, flash discharge tube 1 according to the present exemplary embodiment will be described with reference to FIGS. 1A and 1B.

Figure 1A:
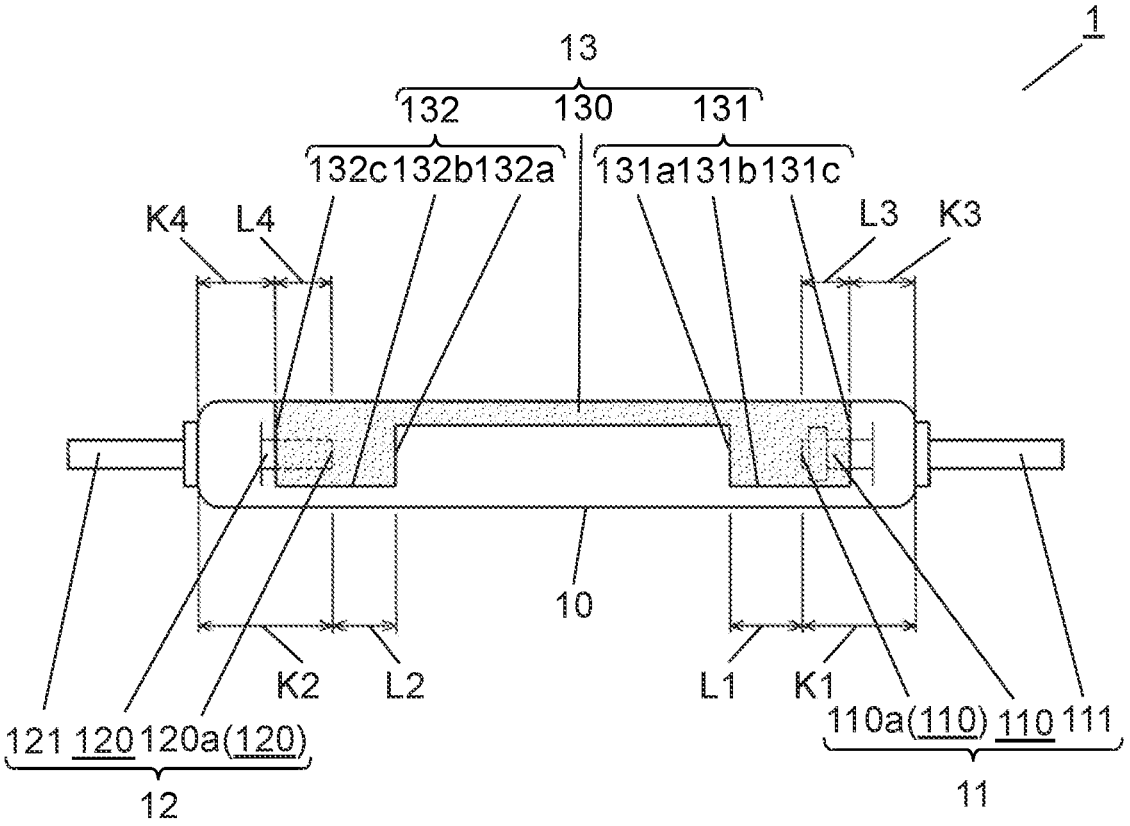
FIG. 1A is a diagram illustrating a flash discharge tube according to an exemplary embodiment of the present invention.

FIG. 1A is a diagram illustrating an example of flash discharge tube 1 according to the exemplary embodiment of the present invention. FIG. 1B is a plan view illustrating trigger electrode 13 in a developed state.

As illustrated in FIG. 1A, flash discharge tube 1 of the present exemplary embodiment includes glass tube 10, cathode electrode 11, anode electrode 12, trigger electrode 13, and the like. Glass tube 10 is filled with a rare gas such as xenon gas under predetermined pressure. Cathode electrode 11 and anode electrode 12 are disposed in a first end portion and a second end portion of glass tube 10, respectively, facing each other. Trigger electrode 13 is composed of a transparent conductive film and is formed on an outer peripheral surface of glass tube 10.

Glass tube 10 is made of, for example, borosilicate glass, aluminosilicate glass, or the like. Aluminosilicate glass, as with quartz glass, contains almost no alkali component that functions as a conductive carrier. Thus, even when temperature rises, ions of sodium, which are each an alkaline component, for example, do not move inside glass tube 10. In other words, glass tube 10 is capable of continuous light emission at short intervals because electrical characteristics such as relative permittivity and a dielectric loss rate do not change significantly even when the temperature rises. The aluminosilicate glass is also cheaper than quartz glass, so that glass tube 10 can be manufactured at low cost.

Cathode electrode 11 and anode electrode 12 of flash discharge tube 1 of the present exemplary embodiment are basically identical in configuration.

That is, cathode electrode 11 includes in-tube electrode portion 110, external terminal 111, and the like. In-tube electrode portion 110 constitutes a portion that is inserted into an interior of glass tube 10 along the tube axis direction of glass tube 10 toward a center of glass tube 10. External terminal 111 constitutes a portion that is led out toward outside glass tube 10 along the tube axis direction of glass tube 10.

Similarly, anode electrode 12 includes in-tube electrode portion 120, external terminal 121, and the like. In-tube electrode portion 120 constitutes a portion that is inserted into the interior of glass tube 10 along the tube axis direction of glass tube 10 toward a center of glass tube 10. External terminal 121 constitutes a portion that is led out toward outside glass tube 10 along the tube axis direction of glass tube 10.

External terminal 111 of cathode electrode 11 and external terminal 121 of anode electrode 12 are connected to a light emitting circuit (not illustrated) of flash device 2 (see FIG. 3A) described later that causes flash discharge tube 1 to emit light.

Figure 1B:
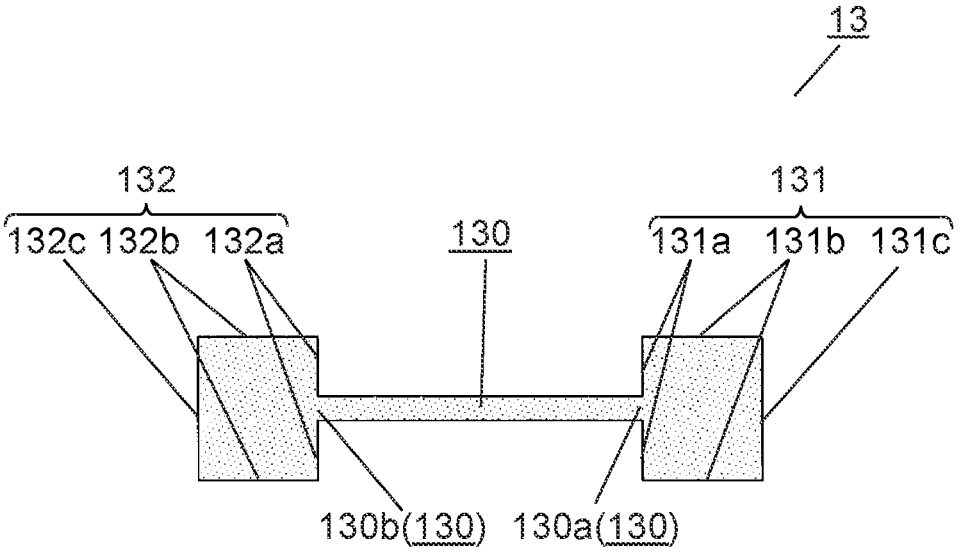
FIG. 1B is a plan view illustrating a state where a trigger electrode is expanded.

As illustrated in FIG. 1B, trigger electrode 13 includes electrode body 130, cathode-side enlarged portion 131 and anode-side enlarged portion 132 that each have a circumferential width wider than electrode body 130, and the like. The present exemplary embodiment allows trigger electrode 13 to be formed on the outer peripheral surface of glass tube 10 on an upper side in FIG. 1A along the tube axis direction (longitudinal direction) of glass tube 10 in an H-shape as a whole, for example. Here, the tube axis direction (longitudinal direction) is a direction connecting circular centers of cathode electrode 11 and anode electrode 12, in a cylindrical shape, disposed at respective opposite ends of glass tube 10, and the same applies in the following description. When cathode-side enlarged portion 131 and anode-side enlarged portion 132 are described without being distinguished from each other, they are each simply referred to as "enlarged portions" as described above.

Trigger circuit 21 (see FIG. 3A) described later causes a trigger voltage to be applied to enlarged portions (corresponding to cathode-side enlarged portion 131 and anode-side enlarged portion 132 in the present exemplary embodiment) formed at respective opposite ends of trigger electrode 13.

Electrode body portion 130 of trigger electrode 13 is formed on the outer peripheral surface of glass tube 10, between inner end 110*a* of in-tube electrode portion 110 of cathode electrode 11 and inner end 120*a* of in-tube electrode portion 120 of anode electrode 12, linearly along the tube axis direction of glass tube 10. At this time, electrode body 130 is formed with a width in a circumferential direction of glass tube 10, the width corresponding to an angle within a range of, for example, 20° to 100° in the circumferential direction along the outer peripheral surface of glass tube 10 around a tube axis of glass tube 10. Electrode body 130 is also formed with a length in a tube axis direction of trigger electrode 13, the length being, for example, 50% or more of an entire length (100%) of trigger electrode 13 in the tube axis direction. This allows a stable discharge optical path to be formed in glass tube 10 during light emission with a small amount of light. As a result, variations in optical distribution characteristics of flash discharge tube 1 and flash device 2 including flash discharge tube 1 can be reduced.

Cathode-side enlarged portion 131 of trigger electrode 13 is extended to end 130*a* of electrode body 130 and is formed, for example, in a substantially semi-cylindrical shape along the outer peripheral surface of glass tube 10 in the circumferential direction. Cathode-side enlarged portion 131 is formed with a width in the circumferential direction, the width being more than the width of electrode body 130 in the circumferential direction. Specifically, as illustrated in FIG. 1A, cathode-side enlarged portion 131 has a size that covers, for example, about 40% of a portion substantially above in-tube electrode portion 110 of cathode electrode 11 in the tube axis direction. Flash discharge tube 1 of the present exemplary embodiment preferably includes cathode-side enlarged portion 131 that is formed with a width in the circumferential direction, corresponding to an angle within a range of, for example, 100° to 360° in the circumferential direction along the outer peripheral surface of glass tube 10 around the tube axis of glass tube 10, the width being more than that of electrode body 130. Cathode-side enlarged portion 131 more preferably has a width in the circumferential direction, corresponding to an angle within a range of 100° to 270°.

As illustrated in FIG. 1B, cathode-side enlarged portion 131 includes two circumferential inner edges 131*a*, two axial edges 131*b*, one circumferential outer edge 131*c*, and the like. Two circumferential inner edges 131*a* are connected to end 130*a* of electrode body 130 and respectively extend in circumferential directions different from each other of glass tube 10 formed with two circumferential inner edges 131*a*. Two axial edges 131*b* each extend from a circumferential end of the corresponding one of two circumferential inner edges 131*a* toward an edge close to cathode electrode 11 (circumferential outer edge 131*c*) along the tube axis direction of glass tube 10. Circumferential outer edge 131*c* connects ends of respective two axial edges 131*b*. The present exemplary embodiment is preferably configured such that cathode-side enlarged portion 131 located closer to the center of glass tube 10 than inner end 110*a* of in-tube electrode portion 110 of cathode electrode 11 is has a length (corresponding to distance L1 in FIG. 1A) in the tube axis direction, the length being within a range of, for example, 10% to 90% of a total length of in-tube electrode portion 110 (corresponding to K1=L3+K3 (100%)). The present exemplary embodiment includes in-tube electrode portion 110 that has a total length designed to be 8 mm, for example. It is needless to say that the above numerical values are examples and may be changed depending on a shape of flash discharge tube 1 and required characteristics thereof. Cathode-side enlarged portion 131 more preferably has a length in the tube axis direction that is within a range of 10% to 50% of the total length (100%) of in-tube electrode portion 110. Specifically, cathode-side enlarged portion 131 of the present exemplary embodiment has distance L1 between circumferential inner edge 131*a* and inner end 110*a* of in-tube electrode portion 110, being designed to be, for example, 1 mm to 3 mm. That is, during light emission, inner end 110*a* of in-tube electrode portion 110 of cathode electrode 11 and its periphery are increased in temperature due to heat generated by electric discharge. Thus, when trigger electrode 13 has a narrow width in the circumferential direction, trigger electrode 13 may be burned out due to expansion of glass tube 10 caused by the heat generation. This causes trigger electrode 13 to include cathode-side enlarged portion 131 covering inner end 110*a* of in-tube electrode portion 110 of cathode electrode 11 and its periphery. This structure allows trigger electrode 13 and glass tube 10 to increase in strength to be less likely to crack. Even when a crack occurs, cathode-side enlarged portion 131 having a long circumferential length can prevent the crack from extending and expanding. As a result, trigger electrode 13 can be prevented from being cut due to the crack in cathode-side enlarged portion 131.

Anode-side enlarged portion 132 of trigger electrode 13 is formed in the same shape as cathode-side enlarged portion 131, and includes two circumferential inner edges 132*a*, two axial edges 132*b*, one circumferential outer edge 132*c*, and the like, as with cathode-side enlarged portion 131. Anode-side enlarged portion 132 is extended to end 130*b* of electrode body 130 and is formed, for example, in a substantially semi-cylindrical shape along the outer peripheral surface of glass tube 10 in the circumferential direction.

Anode-side enlarged portion 132 is formed with a width in the circumferential direction, the width being more than the width of electrode body 130 in the circumferential direction. Specifically, as illustrated in FIG. 1A, anode-side enlarged portion 132 has a size that covers, for example, about 20% of a portion substantially above in-tube electrode portion 120 of anode electrode 12 in the tube axis direction. The present exemplary embodiment is preferably configured such that anode-side enlarged portion 132 located closer to the center of glass tube 10 than inner end 120*a* of in-tube electrode portion 120 of anode electrode 12 is has a length (corresponding to distance L2 in FIG. 1A) in the tube axis direction, the length being within a range of, for example, 10% to 90% of a total length of in-tube electrode portion 120 (corresponding to K2=L4+K4 (100%)). The present exemplary embodiment includes in-tube electrode portion 120 that has a total length designed to be 7 mm, for example. It is needless to say that the above numerical values are examples and may be changed depending on a shape of flash discharge tube 1 and required characteristics thereof. Anode-side enlarged portion 132 more preferably has a length in the axis direction that is within the range of 40% to 90% of a total length (100%) of in-tube electrode portion 120. Specifically, anode-side enlarged portion 132 of the present exemplary embodiment has distance L2 between circumferential inner edge 132*a* and inner end 120*a* of in-tube electrode portion 120, being designed to be, for example, 3 mm to 5 mm. This allows flash discharge tube 1 of the present exemplary embodiment to have distance L2 described above that is designed to be 40% to 90% of the total length of in-tube electrode portion 120. This structure enables anode-side enlarged portion 132 to be more reliably prevented from cracking as in the above description of cathode-side enlarged portion 131.

Trigger circuit 21 (see FIG. 3A) described later applies a trigger voltage of about 5 kV or more to cathode-side enlarged portion 131 and anode-side enlarged portion 132. At this time, external discharge may occur between cathode-side enlarged portion 131 and external terminal 111 of cathode electrode 11, and between anode-side enlarged portion 132 and external terminal 121 of anode electrode 12. Thus, to prevent the external discharge, a creepage distance needs to be secured not only between cathode-side enlarged portion 131 and external terminal 111 of cathode electrode 11, but also between anode-side enlarged portion 132 and external terminal 121 of anode electrode 12. This allows flash discharge tube 1 of the present exemplary embodiment to have distance K3 corresponding to the creepage distance, e.g., from a first end of glass tube 10 to circumferential outer edge 131*c* of cathode-side enlarged portion 131, being designed to be 4 mm or more. Similarly, distance K4 corresponding to the creepage distance, between a second end of glass tube 10 and circumferential outer edge 132*c* of anode-side enlarged portion 132, is designed to be 4 mm or more.

Cathode-side enlarged portion 131 needs to be in electrical contact with trigger band 220 (see FIG. 3A) that constitutes trigger connecting member 22 described later. Thus, distance L3 between circumferential outer edge 131*c* of cathode-side enlarged portion 131 and inner end 110*a* of in-tube electrode portion 110 is preferably designed to be within a range of, for example, 10% to 80% of an electrode length of in-tube electrode portion 110 (100%). Distance L3 is more preferably set to a length within a range of 50% to 80% of the electrode length of in-tube electrode portion 110. This enables not only cathode-side enlarged portion 131 and in-tube electrode portion 110 to overlap each other, but also trigger band 220 to be connected to cathode-side enlarged portion 131 without entering a discharge path side from inner end 110*a* of in-tube electrode portion 110. Distance L3 is a length corresponding to a specific dimension of about 2.5 mm to 6.4 mm. This allows flash discharge tube 1 of the present exemplary embodiment to have distance L3 described above that is designed to be a length within a range of 50% to 80% when the electrode length of in-tube electrode portion 110 of cathode electrode 11 is assigned as 100%.

Similarly, anode-side enlarged portion 132 needs to be in electrical contact with branch line 212 (see FIG. 3A) described later. Thus, distance L4 between circumferential outer edge 132*c* of anode-side enlarged portion 132 and inner end 120*a* of in-tube electrode portion 120 is preferably designed to be within a range of, for example, 10% to 80% of an electrode length of in-tube electrode portion 120 (100%). Distance L4 is more preferably set to a length within a range of 10% to 50% of the electrode length of in-tube electrode portion 120. Distance L4 is a length corresponding to a specific dimension of about 0.5 mm to 2.5 mm. This allows flash discharge tube 1 of the present exemplary embodiment to have distance L4 described above that is designed to be a length within a range of 10% to 50% when the electrode length of in-tube electrode portion 120 of is assigned as 100%.

Flash discharge tube 1 of the present exemplary embodiment is configured as described above.

Figure 12:
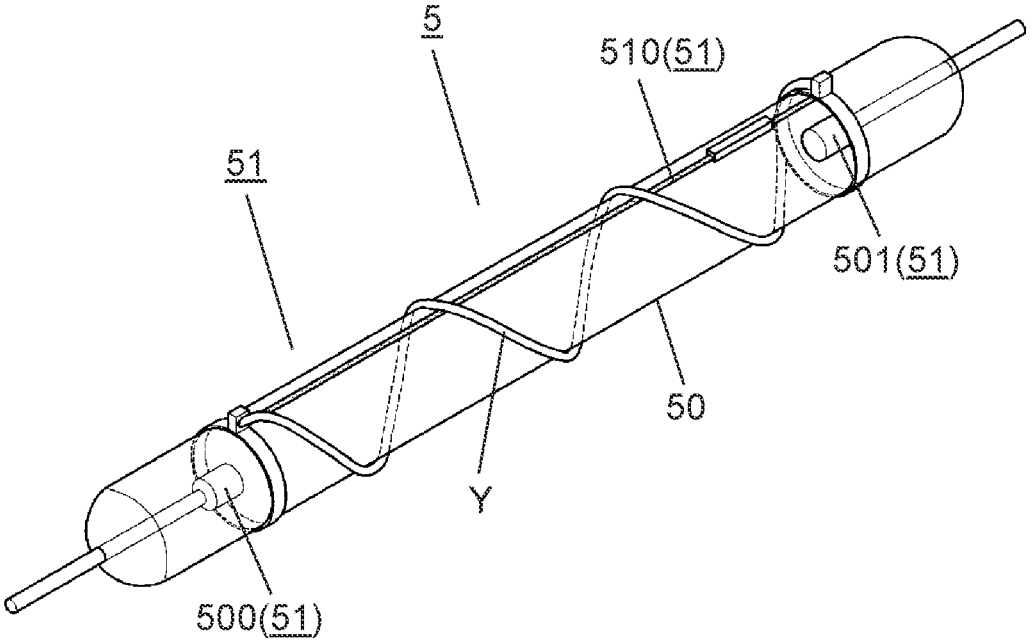
FIG. 12 Prior Art
FIG. 12 is a diagram illustrating yet another conventional flash discharge tube.
Figure 13:
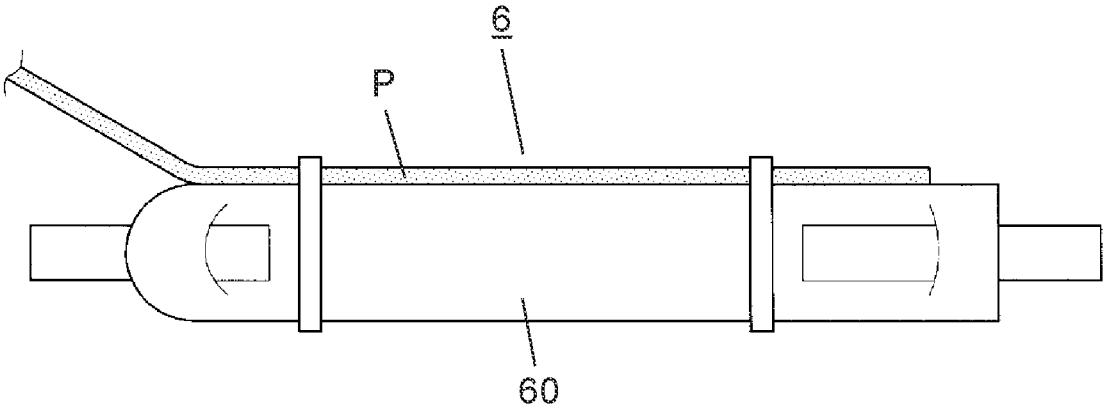
FIG. 13 Prior Art
FIG. 13 is a diagram illustrating yet another conventional flash discharge tube.
Figure 14:
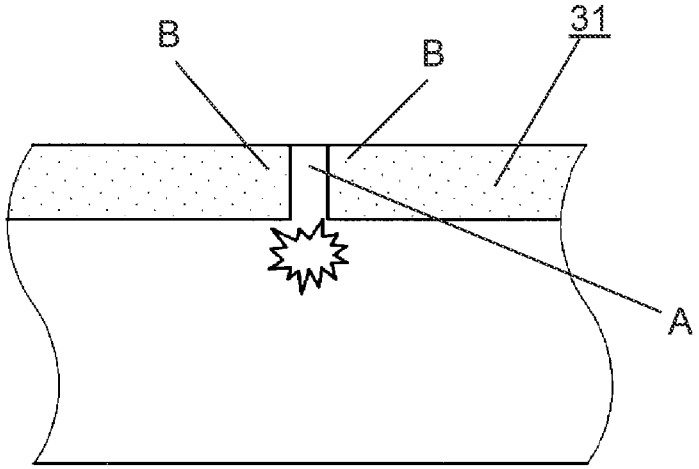
FIG. 14 Prior Art
FIG. 14 is a diagram illustrating a state where a trigger electrode cracks in the conventional flash discharge tube.

As described above, flash discharge tube 1 of the present exemplary embodiment includes trigger electrode 13 composed of a transparent conductive film. That is, metal wire Y is not required to be used unlike flash discharge tube 5 illustrated in FIG. 12 described above. This prevents emitted light from being blocked by metal wire Y, and a shadow from being generated on a subject by metal wire Y.

Flash discharge tube 1 of the present exemplary embodiment includes cathode-side enlarged portion 131 and anode-side enlarged portion 132 of trigger electrode 13 that are each formed having a circumferential width wider than a circumferential width of electrode body 130. Thus, cathode-side enlarged portion 131 and anode-side enlarged portion 132 can be more reliably connected to trigger connecting members 22 and 23 described later, respectively, even when they are displaced in the circumferential direction, for example. This facilitates applying trigger voltage supplied from trigger circuit 21 to cathode-side enlarged portion 131 and anode-side enlarged portion 132. This also enables reducing increase in contact resistance in an unstable connection. Thus, heat generation caused by contact resistance can be reduced to prevent defects in trigger electrode 13 caused by peeling or fusing. As a result, burnout of trigger electrode 13 can be more reliably prevented even when continuous light emission with a large amount of light and at short intervals is repeated.

Next, flash device 2 mounted with flash discharge tube 1 described above will be described with reference to FIGS. 2 to 3B.

Figure 2:
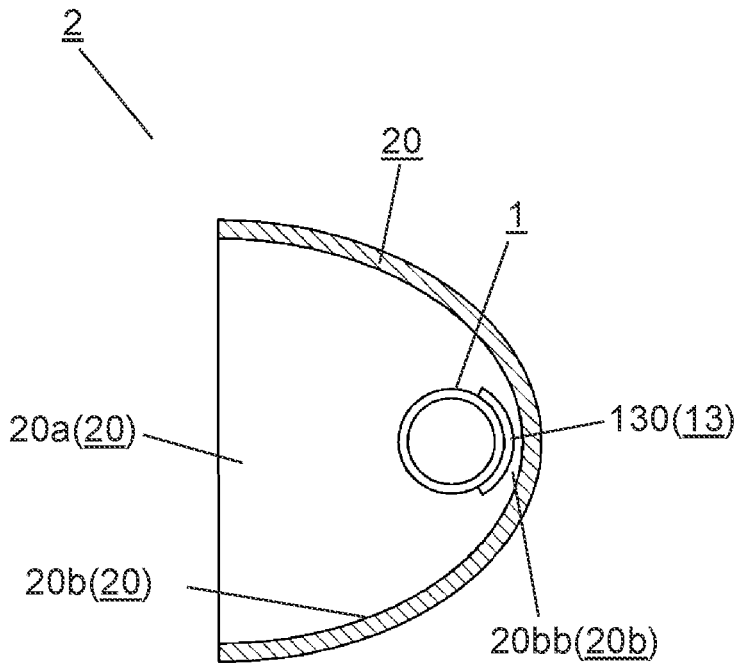
FIG. 2 is a diagram illustrating a flash discharge tube disposed in an umbrella-shaped reflector of a flash device.
Figure 3A:
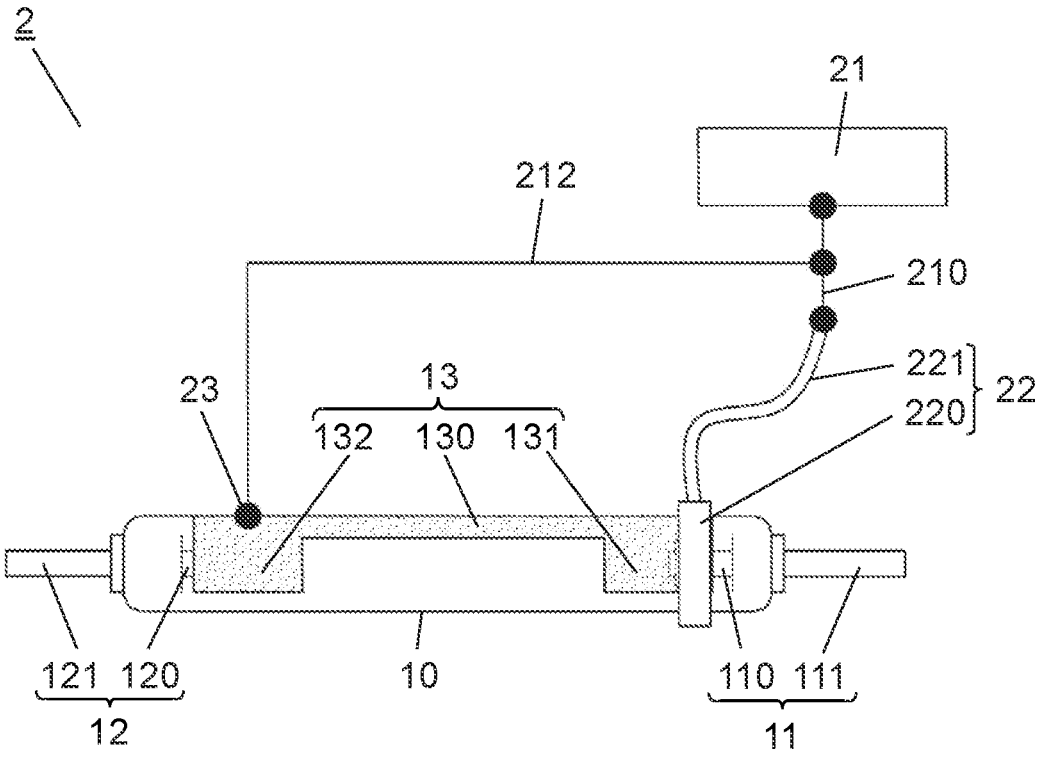
FIG. 3A is a schematic diagram illustrating a flash device including the flash discharge tube of FIG. 1A according to the exemplary embodiment of the present invention.

As illustrated in FIGS. 2 and 3A, flash device 2 of the present exemplary embodiment includes flash discharge tube 1 described above, umbrella-shaped reflector 20, trigger circuit 21, and the like. Umbrella-shaped reflector 20 has opening 20*a* on a side facing a subject. Trigger circuit 21 generates a trigger voltage to be applied to cathode-side enlarged portion 131 and anode-side enlarged portion 132 of trigger electrode 13 of flash discharge tube 1.

Umbrella-shaped reflector 20 includes a curved reflecting surface 20*b*. Flash discharge tube 1 is disposed near deepest portion 20*bb* of reflecting surface 20*b* and near a vertical center of opening 20*a*. Umbrella-shaped reflector 20 reflects light emitted from flash discharge tube 1 on reflecting surface 20*b* to emit the light toward the subject through opening 20*a*. Trigger electrode 13 of flash discharge tube 1 is formed of the transparent conductive film as described above. Thus, flash device 2 including flash discharge tube 1 can be designed with a discharge optical path having a small variation in optical distribution characteristics. Generally, optical distribution characteristics are determined by a positional relationship between an umbrella-shaped reflector and a discharge optical path, and the discharge optical path tends to extend along a trigger electrode. Then, appropriately designing a position (discharge optical path) of the trigger electrode in the umbrella-shaped reflector enables reducing variations in the optical distribution characteristics.

Although an example of structure in which electrode body 130 of trigger electrode 13 is disposed close to deepest portion 20*bb* of umbrella-shaped reflector 20 and near the vertical center of umbrella-shaped reflector 20 is described above as illustrated in FIG. 2, the present invention is not limited to this. For example, electrode body 130 may be disposed close to opening 20*a* and near the vertical center of umbrella-shaped reflector 20.

Trigger circuit 21 of flash device 2 includes connection line 210, branch line 212, and the like, as illustrated in FIG. 3A. Connection line 210 is connected to trigger line 221 of trigger connecting member 22 described later. Branch line 212 is branched from connection line 210 and is connected to anode-side enlarged portion 132 using trigger connecting member 23 described later.

Flash device 2 includes trigger connecting member 22, trigger connecting member 23, and the like, described above. Trigger connecting member 22 is connected to the outer peripheral surface (including cathode-side enlarged portion 131) of glass tube 10, close to cathode electrode 11. Trigger connecting member 23 is connected to the outer peripheral surface (including anode-side enlarged portion 132) of glass tube 10, close to anode electrode 12.

Flash device 2 of the present exemplary embodiment is provided with trigger connecting member 22 that is connected to a portion of cathode-side enlarged portion 131, close to cathode electrode 11 and that includes trigger band 220, trigger line 221, and the like. Trigger band 220 is circumferentially wound around a portion of the outer peripheral surface of glass tube 10, close to cathode electrode 11. Trigger line 221 is connected to or integrated with trigger band 220.

In contrast, trigger connecting member 23 connected to a portion of anode-side enlarged portion 132, close to anode electrode 12, is formed of an elastic member such as a spring, and is not fixed to anode-side enlarged portion 132 with an adhesive, for example. When the elastic member is the spring, branch line 212 of trigger circuit 21 is brought into pressure contact with anode-side enlarged portion 132 using the spring, and is connected to anode-side enlarged portion 132. Trigger connecting member 23 is not fixed because a voltage is secondarily applied to anode-side enlarged portion 132 from trigger circuit 21. That is, although electrical connection to trigger electrode 13 can be secured by trigger connecting member 22, a trigger voltage is more preferably applied from both sides of trigger electrode 13 to allow both the sides to be identical in potential. Thus, in consideration of ease of assembly and cost, branch line 212 of trigger circuit 21 is particularly connected to anode-side enlarged portion 132 without being fixed.

That is, flash device 2 of the present exemplary embodiment includes trigger connecting member 23 that is connected to a portion of anode-side enlarged portion 132, close to anode electrode 12, and that is formed of an elastic member such as a spring allowing branch line 212 of a trigger coil to be brought into pressure contact with anode-side enlarged portion 132.

Hereinafter, another example of the elastic member will be described with reference to FIG. 6.

Figure 6:
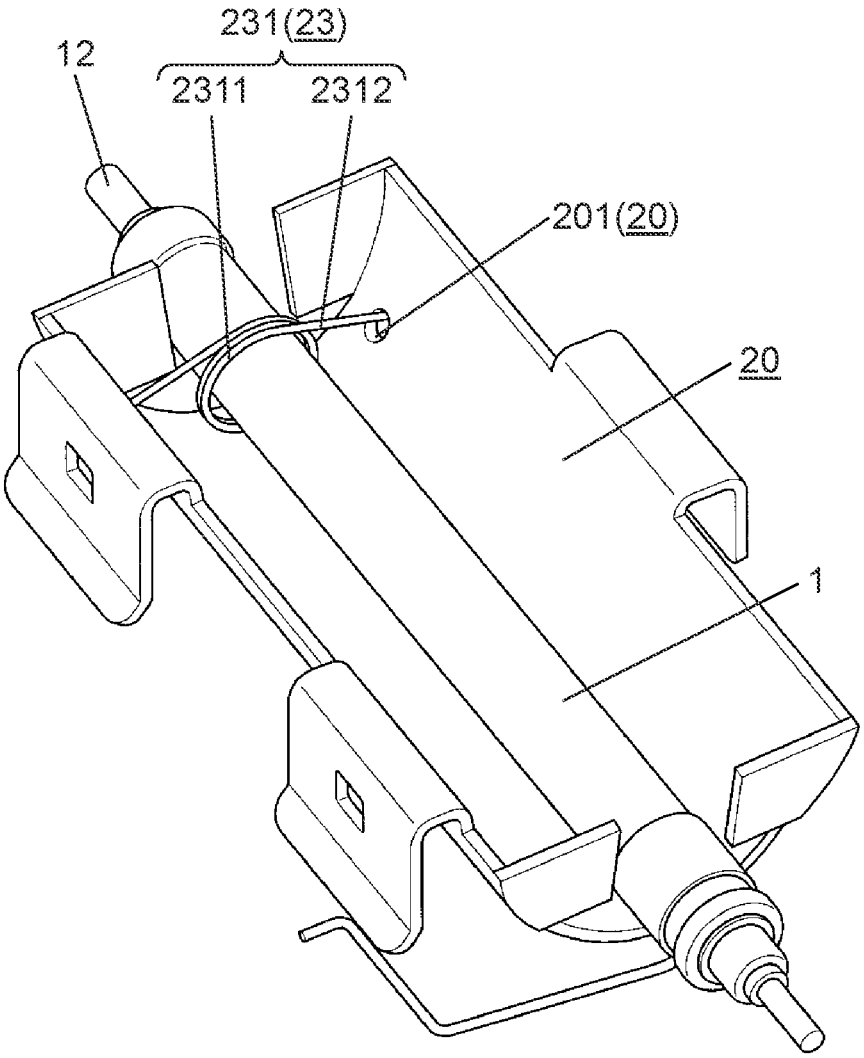
FIG. 6 is a diagram illustrating an example (winding spring) of a trigger connecting member.

First, winding spring 231 illustrated in FIG. 6 is exemplified as the elastic member, for example.

Winding spring 231 includes coil-shaped portion 2311 and protruding portions 2312. Coil-shaped portion 2311 is formed by rolling a spring material into a coil shape. Coil-shaped portion 2311 is disposed surrounding an outer circumference of flash discharge tube 1. Protruding portions 2312 are formed linearly protruding from respective opposite ends of coil-shaped portion 2311. Protruding portions 2312 are each disposed passing through through-hole 201 of umbrella-shaped reflector 20, provided close to anode electrode 12. This allows winding spring 231 constituting trigger connecting member 23 to be supported by umbrella-shaped reflector 20 using protruding portions 2312.

Flash device 2 according to the present exemplary embodiment is configured as described above.

Flash device 2 includes branch line 212 that branches from connection line 210 of the trigger coil connected to cathode-side enlarged portion 131 and that is connected to anode-side enlarged portion 132 using trigger connecting member 23. This facilitates processing work such as connection, so that flash device 2 can be manufactured at low cost.

Figure 3B:
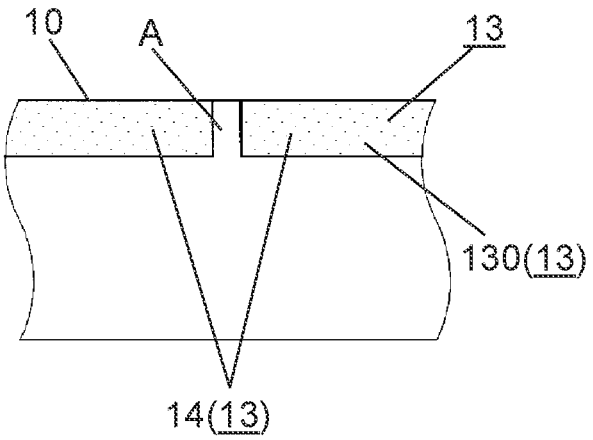
FIG. 3B is a diagram illustrating a state where a trigger electrode cracks.

Flash discharge tube 1 of flash device 2 includes cathode-side enlarged portion 131 and anode-side enlarged portion 132 that are each formed with a width in the circumferential direction of glass tube 10, the width being wider than a width of electrode body 130 of trigger electrode 13. Thus, as described above, even when glass tube 10 expands and contracts in the tube axis direction due to heat generation and heat accumulation caused by continuous emission of a large amount of light at short intervals, by applying the trigger voltage to cathode-side enlarged portion 131 and anode-side enlarged portion 132 using trigger circuit 21, the conductive film constituting trigger electrode 13 formed on the outer peripheral surface of glass tube 10 is less likely to crack. For example, even when crack A is generated in the conductive film as illustrated in FIG. 3B, no potential difference is generated between opposing end portions 14 of the conductive film caused by crack A (between adjacent conductors). This is because cathode-side enlarged portion 131 and anode-side enlarged portion 132 of trigger electrode 13 are connected to connection line 210 and branch line 212 of trigger circuit 21 using trigger connecting members 22, 23, respectively, and are identical in potential, and thus there is no potential difference. Thus, between opposing end portions 14 across crack A of the conductive film, a spark caused by air discharge, for example, does not occur on the outer peripheral surface of glass tube 10. As a result, the crack of the conductive film constituting trigger electrode 13 does not expand and develop.

As described above, flash discharge tube 1 of the present exemplary embodiment and flash device 2 using the same enables reducing variations in optical distribution characteristics during light emission with a small amount of light. Additionally, life and durability during continuous light emission with a large amount of light at short intervals can be improved. Further, reduction in number of manufacturing steps of flash discharge tube 1 enables flash discharge tube 1 and flash device 2 using the same to be manufactured at low cost.

The present invention can be modified in various ways without being limited to the above exemplary embodiment.

Figure 4A:
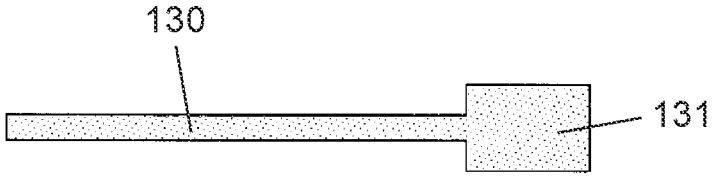
FIG. 4A is a diagram illustrating a modification in shape of the trigger electrode.

Although the exemplary embodiment above describes the example structure in which cathode-side enlarged portion 131 and anode-side enlarged portion 132 each having a wide width are formed at ends 130*a*, 130*b* of electrode body 130 of trigger electrode 13 in a linear shape as an example, the present invention is not limited to this. For example, as illustrated in FIG. 4A, only cathode-side enlarged portion 131 may be formed having a wide width. Although not illustrated, only anode-side enlarged portion 132 may be formed having a wide width.

Although the exemplary embodiment above describes the structure in which cathode-side enlarged portion 131 and anode-side enlarged portion 132 include respectively two circumferential inner edges 131*a* and two circumferential inner edges 132*a* that continuously extend respectively from ends 130*a*, 130*b* of electrode body 130 of trigger electrode 13 in circumferential directions different from each other, the present invention is not limited to this.

Figure 4B:
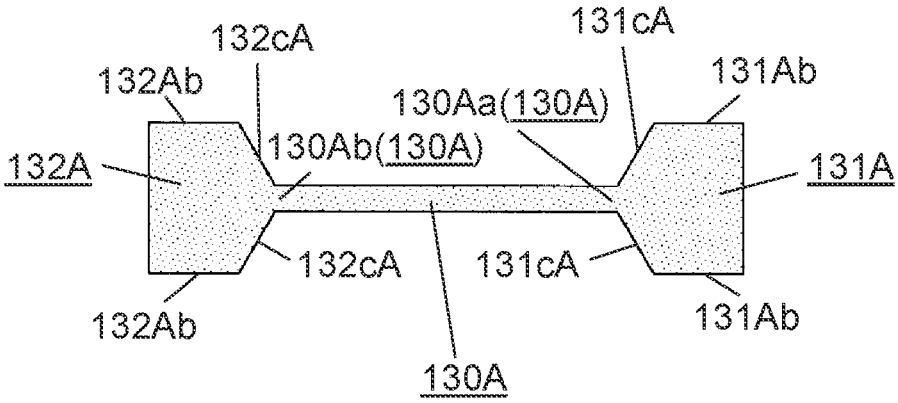
FIG. 4B is a diagram illustrating another modification in shape of a trigger electrode.

For example, as illustrated in FIG. 4B, cathode-side enlarged portion 131A and anode-side enlarged portion 132A may respectively include diagonally inner edges 131*c*A and 132*c*A that respectively extend from ends 130Aa, 130Ab of electrode body 130A narrow in width toward axial edges 131Ab, 132Ab of cathode-side enlarged portion 131A wide in width and anode-side enlarged portion 132A wide in width.

Figure 4C:
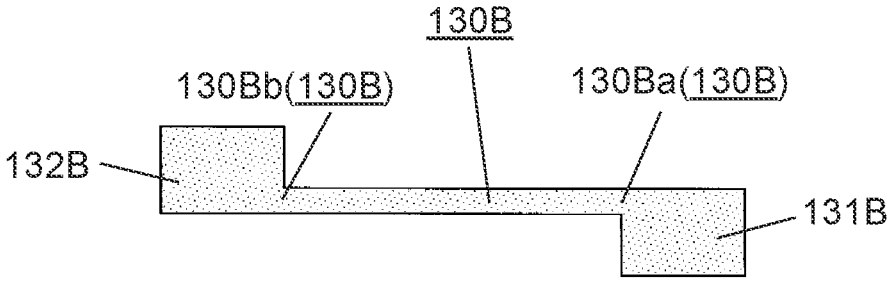
FIG. 4C is a diagram illustrating yet another modification in shape of the trigger electrode.
Figure 4D:
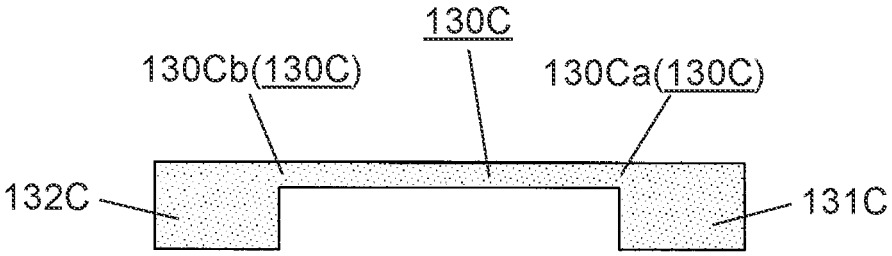
FIG. 4D is a diagram illustrating yet another modification in shape of the trigger electrode.

Although the above exemplary embodiment describes the structure of trigger electrode 13 formed in an H-shape, the present invention is not limited to this. For example, as illustrated in FIG. 4C, two cathode-side enlarged portion 131B and anode-side enlarged portion 132B, being wide in width, may be formed extending from ends 130Ba, 130Bb of electrode body 130B narrow in width, respectively, in respective different circumferential directions. Additionally, as illustrated in FIG. 4D, two cathode-side enlarged portion 131C and anode-side enlarged portion 132C, being wide in width, may be formed extending from ends 130Ca, 130Cb of electrode body 130C narrow in width, respectively, in the same circumferential direction.

Although the above exemplary embodiment describes the example structure in which the trigger voltage is applied to both cathode-side enlarged portion 131 and anode-side enlarged portion 132 of trigger electrode 13, the present invention is not limited to this. For example, a trigger voltage identical in potential may be applied to each of electrode body 130, cathode-side enlarged portion 131, and anode-side enlarged portion 132 of trigger electrode 13.

Figure 5A:
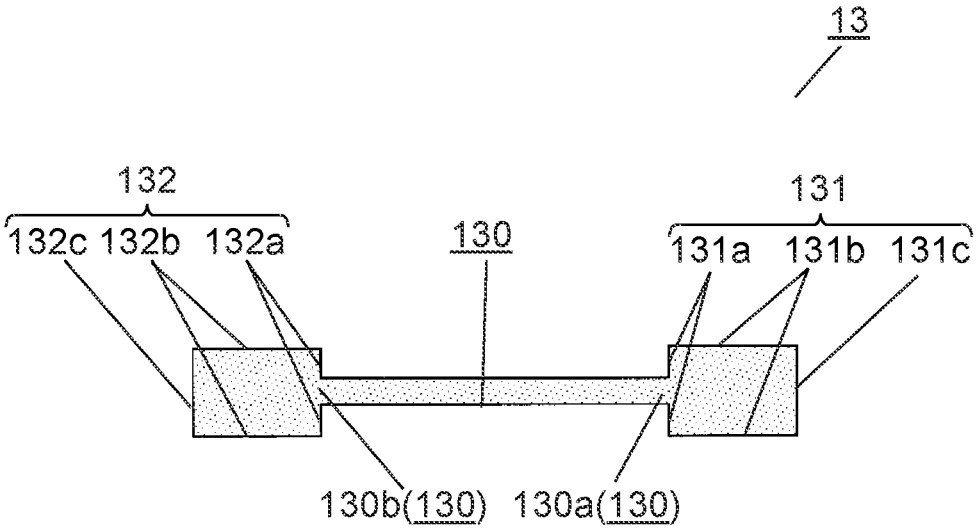
FIG. 5A is a diagram illustrating an example of a method for applying a trigger voltage to the trigger electrode.

Although the above exemplary embodiment describes the example structure in which the trigger voltage is applied to cathode-side enlarged portion 131 and anode-side enlarged portion 132 of trigger electrode 13, the present invention is not limited to this. For example, as illustrated in FIG. 5A, the trigger voltage may be applied to ends 130*a*, 130*b* of electrode body 130 that are respectively located at circumferential inner edge 131*a* of cathode-side enlarged portion 131 and circumferential inner edge 132*a* of anode-side enlarged portion 132.

Figure 5B:
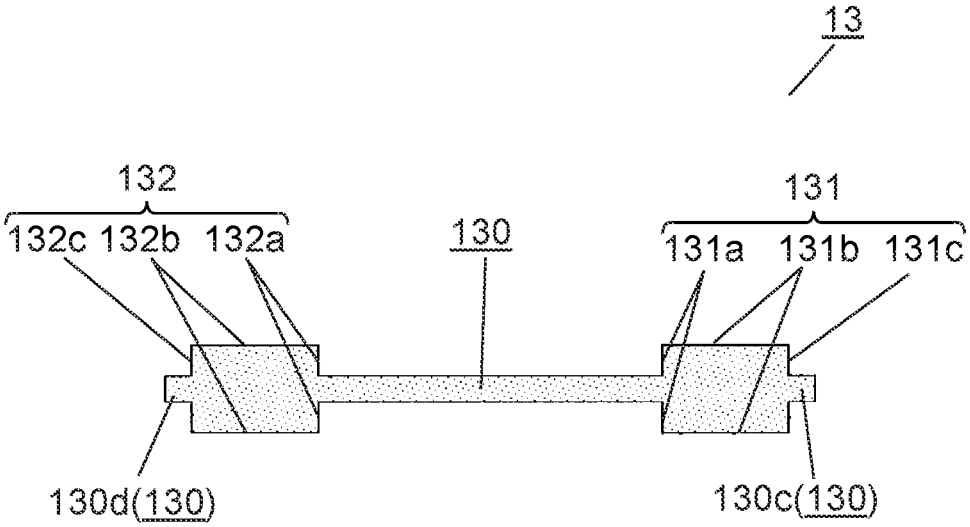
FIG. 5B is a diagram illustrating another example of the method for applying the trigger voltage to the trigger electrode.

Additionally, for example, as illustrated in FIG. 5B, the trigger voltage may be applied to extension portions 130*c* and 130*d* that are respectively provided extending outward from circumferential outer edges 131*c*, 132*c* of cathode-side enlarged portion 131 and anode-side enlarged portion 132 in an extending direction of electrode body 130 and that are identical in width to electrode body 130.

Figure 7:
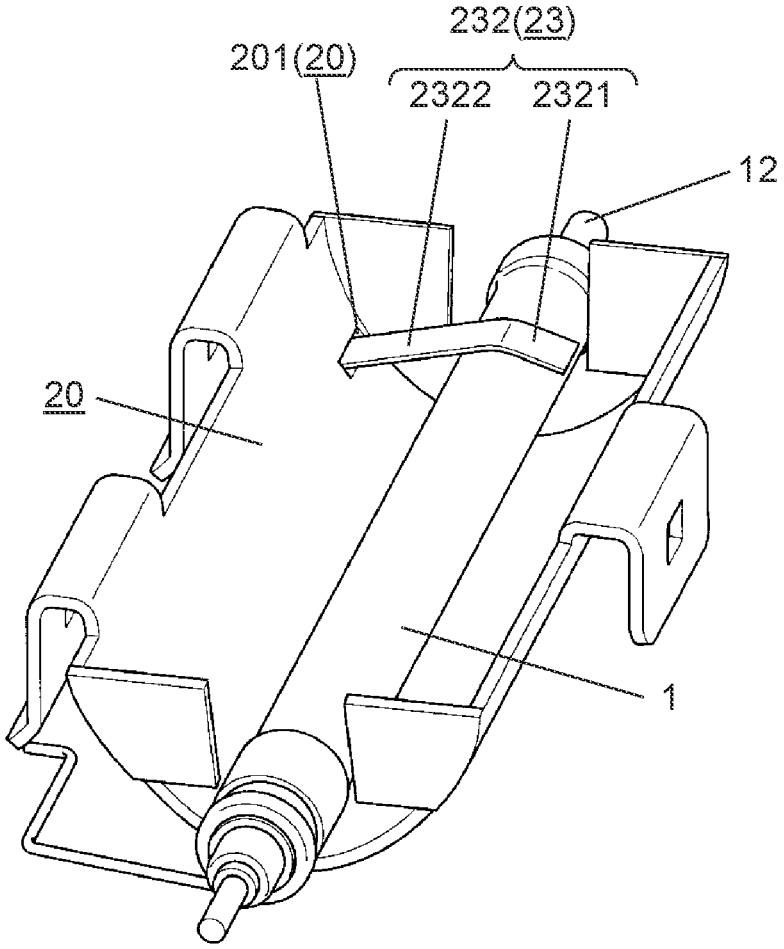
FIG. 7 is a diagram illustrating another example (leaf spring) of the trigger connecting member.

Although the above exemplary embodiment describes the example structure in which winding spring 231 is used as the elastic member of trigger connecting member 23, the present invention is not limited to this. For example, leaf spring 232 may be used as the elastic member, as illustrated in FIG. 7. Specifically, leaf spring 232 may be supported by umbrella-shaped reflector 20 such that first end portion 2321 of leaf spring 232 is brought into contact with anode-side enlarged portion 132 of trigger electrode 13 (see FIG. 1A), and second end portion 2322 thereof is caused to pass through through-hole 201 of umbrella-shaped reflector 20. At this time, first end portion 2321 of leaf spring 232 may be further extended, and opposite ends of leaf spring 232 may be supported in respective through-holes 201 formed in umbrella-shaped reflector 20. In this case, for example, a central portion of leaf spring 232 in a mountain shape may be brought into contact with anode-side enlarged portion 132. This enables flash discharge tube 1 to be more reliably supported by umbrella-shaped reflector 20.

Although not illustrated, a part of umbrella-shaped reflector 20 may be projected toward flash discharge tube 1, and a tip portion of the projected portion may be brought into contact with anode-side enlarged portion 132 by itself like leaf spring 232.

Although not illustrated, a trigger band identical in shape to trigger band 220 of trigger connecting member 22 connected to a portion of cathode-side enlarged portion 131, close to cathode electrode 11, may be provided in trigger connecting member 23 connected to a portion of anode-side enlarged portion 132, close to anode electrode 12, to bring the trigger band and anode-side enlarged portion 132 into contact with each other.

Figure 8:
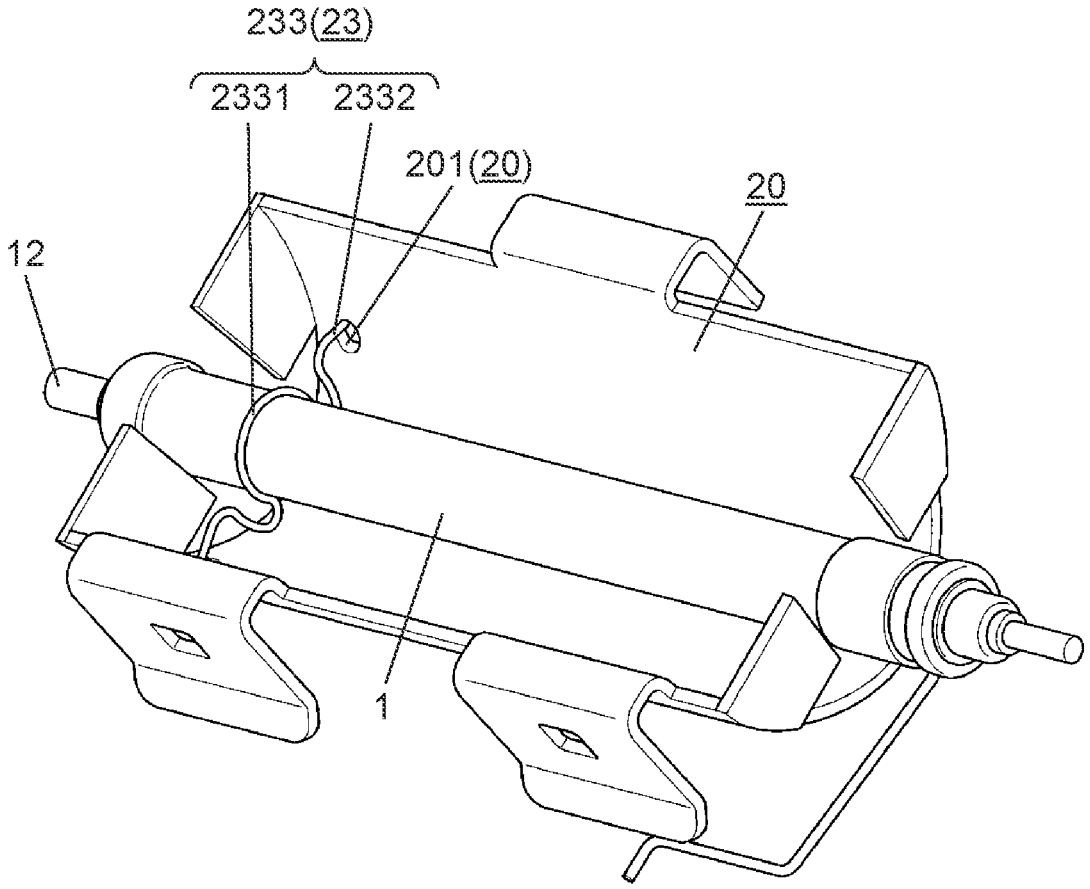
FIG. 8 is a diagram illustrating yet another example (a spring having a substantially "Ω" shape) of the trigger connecting member.

As illustrated in FIG. 8, the elastic member may be formed of spring 233 having a substantially "Ω" shape. In this case, as with winding spring 231 of the above exemplary embodiment, central curved portion 2331 of the substantially "Ω" shape is disposed surrounding the outer circumference of flash discharge tube 1. Then, projections 2332 of spring 233, projecting from respective opposite sides of the substantially "Ω" shape, are caused to pass through respective through-holes 201 of umbrella-shaped reflector 20. This allows spring 233 having the substantially "Ω" shape to be supported by umbrella-shaped reflector 20.

Figure 9:
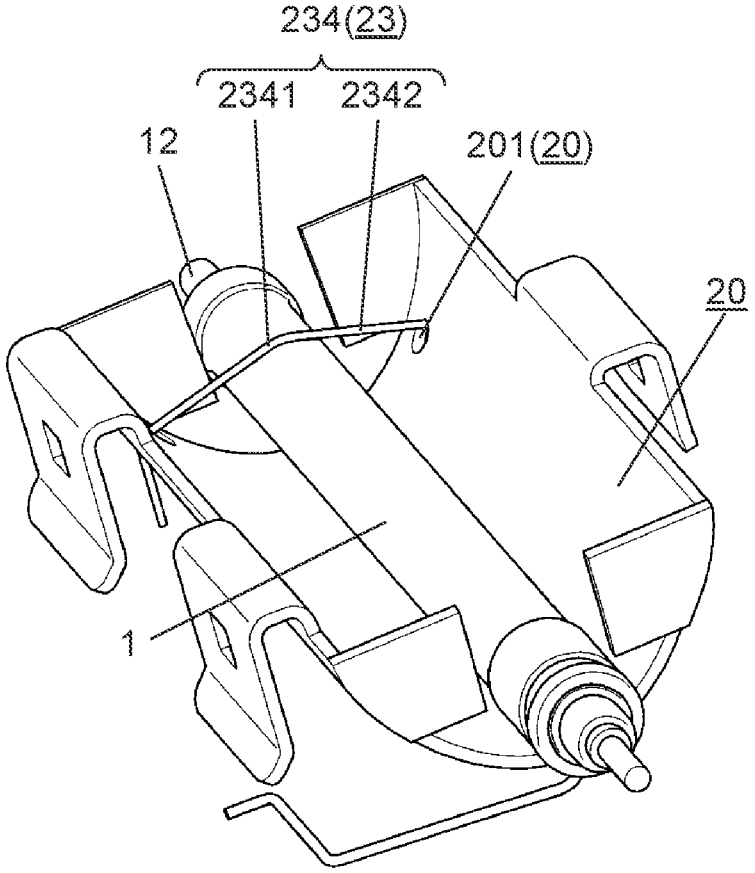
FIG. 9 is a diagram illustrating yet another example (linear member) of the trigger connecting member.
Figure 10:
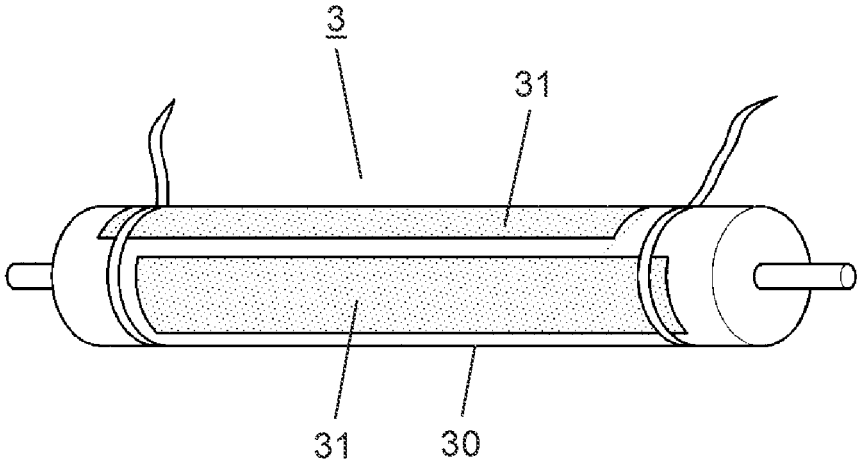
FIG. 10 is a diagram illustrating a conventional flash discharge tube.
Figure 11:
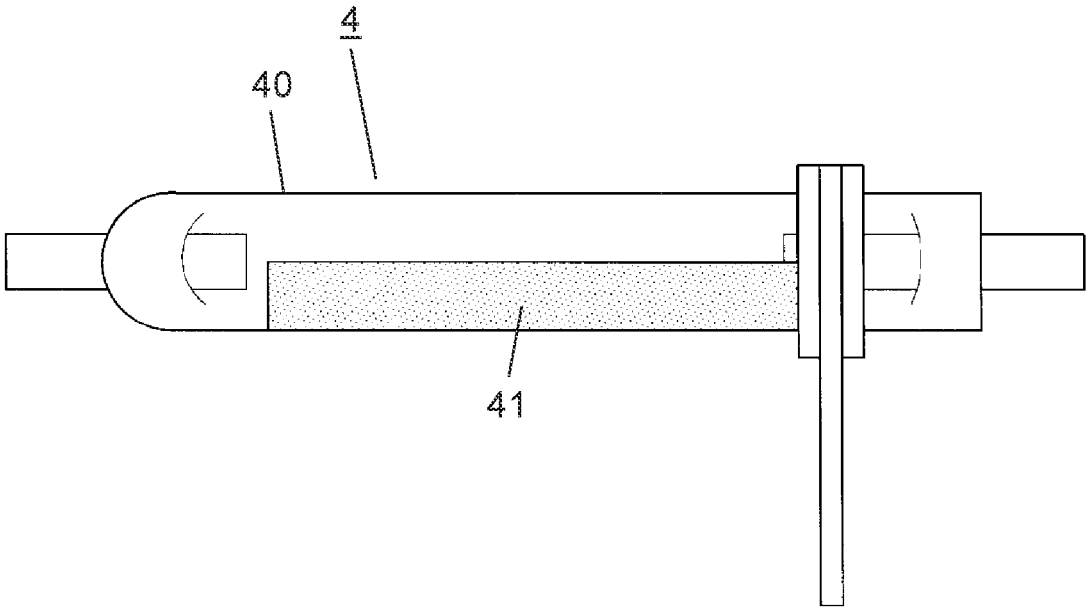
FIG. 11 Prior Art
FIG. 11 is a diagram illustrating another conventional flash discharge tube.

The elastic member may be formed of linear member 234 made of a wire or the like, as illustrated in FIG. 9. At this time, central portion 2341 of linear member 234 is brought into contact with anode-side enlarged portion 132 (see FIG. 1A) of trigger electrode 13. Then, opposite end portions 2342 of linear member 234 are caused to pass through respective through-holes 201 of umbrella-shaped reflector 20. Linear member 234 accordingly may be supported by umbrella-shaped reflector 20. In this case, linear member 234 may include two wires that are brought into contact with anode-side enlarged portion 132 of trigger electrode 13 at respective portions close to deepest portion 20*bb* of reflecting surface 20*b* of umbrella-shaped reflector 20 and close to near opening 20*a* of umbrella-shaped reflector 20 (see FIG. 2).

Other than the elastic member of trigger connecting member 23 described above, anode-side enlarged portion 132 of trigger electrode 13 may be configured to be brought into contact with a flexible printed circuit board (FPC), a pins or a screw, or a conductive tape or the like being wound, for example.

Although the above exemplary embodiment describes the example structure in which trigger electrode 13 is made of a conductive film having a uniform thickness, the present invention is not limited to this. Examples may include flash discharge tube 1 including anode-side enlarged portion 132 of trigger electrode 13 that is at least preliminarily coated with conductive paint within a range other than a range from inner end 120*a* of in-tube electrode portion 120 of anode electrode 12 to a tube central portion of glass tube 10. This enables reduction in contact resistance between a portion of anode-side enlarged portion 132, close to anode electrode 12, and the elastic member being trigger connecting member 23. As a result, the amount of heat generated by the contact resistance is reduced, so that occurrence of a crack can be prevented more reliably.

Although the above exemplary embodiment describes the example structure in which winding spring 231 is used as the elastic member, and winding spring 231 is brought into contact with anode-side enlarged portion 132 of trigger electrode 13 at a place close to opening 20*a* of umbrella-shaped reflector 20, the present invention is not limited to this. For example, winding spring 231 may be brought into contact with anode-side enlarged portion 132 of trigger electrode 13 at a place near deepest portion 20*bb* of reflecting surface 20*b* of umbrella-shaped reflector 20.

As described above, the flash discharge tube of the present invention includes the glass tube in which a rare gas under predetermined pressure is sealed, the cathode electrode and the anode electrode disposed in the first end portion and the second end portion of the glass tube, respectively, facing each other, and the trigger electrode including the transparent conductive film formed on the outer peripheral surface of the glass tube. The trigger electrode includes the electrode body disposed on the outer peripheral surface of the glass tube, along the tube axis direction of the glass tube, and the enlarged portion that covers at least any one of the cathode electrode and the anode electrode and that has a circumferential width wider than a circumferential width of the electrode body.

This structure allows the conductive film constituting the trigger electrode on the outer peripheral surface of the glass tube to partly include the enlarged portion. Thus, the trigger electrode formed on the glass tube is less likely to crack. As a result, the life of the flash discharge tube can be extended.

The flash discharge tube of the present invention is preferably configured such that the electrode body is formed with a width in the circumferential direction, the width corresponding to an angle within a range of, for example, 20° to 100° in the circumferential direction along the outer peripheral surface of glass tube 10 around the tube axis of glass tube 10, and with a length in the tube axis direction, the length being 50% or more of the entire length of the trigger electrode in the tube axis direction.

This structure enables a stable discharge optical path to be formed during light emission with a small amount of light. As a result, variations in optical distribution characteristics can be reduced.

The flash discharge tube of the present invention is preferably configured such that the enlarged portion is formed with a width in the circumferential direction, the width corresponding to an angle within a range of, for example, 100° to 360° in the circumferential direction along the outer peripheral surface of glass tube 10 around the tube axis of glass tube 10. The enlarged portion is more preferably formed with a width in the circumferential direction, the width corresponding to an angle within a range of 100° to 270° in the circumferential direction along the outer peripheral surface of the glass tube around the tube axis of the glass tube.

These structures enable securing a sufficient electrical contact area for applying the trigger voltage supplied from the trigger circuit to the trigger electrode formed on the outer peripheral surface of the flash discharge tube.

The flash discharge tube of the present invention is preferably configured such that the cathode electrode and the anode electrode each include an in-tube electrode portion inserted into the interior of the glass tube, and the enlarged portion of the trigger electrode has a portion located closer to the tube center than an inner end of the in-tube electrode portion is, the portion having a length in the tube axis direction within a range of 10% to 90% of the entire length of the in-tube electrode portion.

This structure enables the cathode electrode or the anode electrode to be covered with the enlarged portion of the trigger electrode.

The flash device of the present invention is preferably configured to include at least the above flash discharge tube and the trigger circuit for applying the trigger voltage to the trigger electrode of the flash discharge tube.

This structure causes no spark to be generated between opposing end portions across a crack of the trigger electrode even when the trigger voltage is applied from opposite ends of the trigger electrode while the trigger electrode cracks due to expansion and contraction of the glass tube in the tube axis direction, caused by continuous light emission with a large amount of light at short intervals. This enables extending life of the flash device.

The flash device of the present invention is preferably configured to include an umbrella-shaped reflector that has an opening in a surface facing a subject and that reflects light emitted from the flash discharge tube to emit the light toward the subject through the opening, the flash discharge tube being disposed near a vertical center of the opening of the umbrella-shaped reflector.

The above structure enables stabilizing a discharge optical path of the flash discharge tube, close to the opening of the umbrella-shaped reflector. As a result, variations in optical distribution characteristics of the flash device can be further reduced.

INDUSTRIAL APPLICABILITY

The flash discharge tube of the present invention and the flash device using the same can be effectively used for an imaging apparatus such as a camera, and a high-speed printer, which are required to reduce variations in optical distribution characteristics and to extend life.

REFERENCE MARKS IN THE DRAWINGS

1, 3, 4, 5, 6: flash discharge tube
2: flash device
10, 30, 40, 60: glass tube
11: cathode electrode
12: anode electrode
13, 31, 41: trigger electrode
14: opposing end portion
20: umbrella-shaped reflector
20*a*: opening
20*b*: reflecting surface
20*bb*: deepest portion

21: trigger circuit
22, 23: trigger connecting member
50: arc tube
51: trigger electrode assembly
110, 120: in-tube electrode portion
110*a*, 120*a*: inner end
111, 121: external terminal
130, 130A, 130B, 130C: electrode body
130*a*, 130*b*, 130Aa, 130Ab, 130Ba, 130Bb, 130Ca, 130Cb, 2342: end
130*c*, 130*d*: extension portion
131, 131A, 131B, 131C: cathode-side enlarged portion (enlarged portion)
131*a*, 132*a*: circumferential inner edge
131*b*, 132*b*, 131Ab, 132Ab: axial edge
131*c*, 132*c*: circumferential outer edge
131*c*A, 132*c*A: diagonally inner edge
132, 132A, 132B, 132C: anode-side enlarged portion (enlarged portion)
201: through-hole
210: connection line
212: branch line
220: trigger band
221: trigger line
231: winding spring (elastic member)
232: leaf spring (elastic member)
233: spring (elastic member)
234: linear member (elastic member)
2311: coil-shaped portion
2312: protruding portion
2321: first end portion
2322: second end portion
2331: central curved portion
2332: projection
2341: central portion
500: first electrode
501: second electrode
510: trigger line

The invention claimed is:

1. A flash discharge tube comprising:
a glass tube in which a rare gas under predetermined pressure is sealed;
a cathode electrode and an anode electrode disposed in a first end portion and a second end portion of the glass tube, respectively, facing each other; and
a trigger electrode including a transparent conductive film formed on an outer peripheral surface of the glass tube,
the trigger electrode including
an electrode body disposed on the outer peripheral surface of the glass tube, along a tube axis direction of the glass tube, and
an enlarged portion that covers at least any one of the cathode electrode and the anode electrode and that has a circumferential width wider than a circumferential width of the electrode body.

2. The flash discharge tube according to claim 1, wherein the electrode body is formed with a width in a circumferential direction, the width corresponding to an angle within a range of 20 degrees to 100 degrees in the circumferential direction along the outer peripheral surface of the glass tube around the tube axis of the glass tube, and with a length in the tube axis direction, the length being 50% or more of an entire length of the trigger electrode in the tube axis direction.

3. The flash discharge tube according to claim 1, wherein the enlarged portion is formed with a width in the circumferential direction, the width corresponding to an angle within a range of 100 degrees to 360 degrees in the circumferential direction along the outer peripheral surface of the glass tube around the tube axis of the glass tube.

4. The flash discharge tube according to claim 1, wherein the enlarged portion is formed with a width in the circumferential direction, the width corresponding to an angle within a range of 100 degrees to 270 degrees in the circumferential direction along the outer peripheral surface of the glass tube around the tube axis of the glass tube.

5. The flash discharge tube according to claim 1, wherein
the cathode electrode and the anode electrode each include an in-tube electrode portion inserted into an interior of the glass tube, and
the enlarged portion of the trigger electrode has a portion located closer to the tube center than an inner end of the in-tube electrode portion is, the portion having a length in the tube axis direction within a range of 10% to 90% of an entire length of the in-tube electrode portion.

6. A flash device comprising:
the flash discharge tube according to claim 1; and
a trigger circuit for applying a trigger voltage to the trigger electrode of the flash discharge tube.

7. The flash device according to claim 6, further comprising an umbrella-shaped reflector that has an opening in a surface facing a subject and that reflects light emitted from the flash discharge tube to emit the light toward the subject through the opening,
the flash discharge tube being disposed near a vertical center of the opening of the umbrella-shaped reflector.

* * * * *